US008116502B2

(12) United States Patent
Saggio, Jr. et al.

(10) Patent No.: US 8,116,502 B2
(45) Date of Patent: Feb. 14, 2012

(54) IN-EAR MONITOR WITH CONCENTRIC SOUND BORE CONFIGURATION

(75) Inventors: Joseph A. Saggio, Jr., Anaheim Hills, CA (US); Medford Alan Dyer, San Diego, CA (US)

(73) Assignee: Logitech International, S.A. (CH)

( * ) Notice: Subject to any disclaimer, the term of this patent is extended or adjusted under 35 U.S.C. 154(b) by 277 days.

(21) Appl. No.: 12/641,017

(22) Filed: Dec. 17, 2009

(65) Prior Publication Data

US 2011/0058702 A1 Mar. 10, 2011

Related U.S. Application Data

(60) Provisional application No. 61/276,172, filed on Sep. 8, 2009, provisional application No. 61/281,645, filed on Nov. 19, 2009.

(51) Int. Cl.
*H04R 25/00* (2006.01)

(52) U.S. Cl. ..... 381/380; 381/328; 381/382

(58) Field of Classification Search ..... 381/309, 381/311, 322, 324, 325, 328, 71.6, 71.7, 381/74, 338, 370, 371, 376, 380, 382, 384, 381/182, 186; 181/129, 130, 135
See application file for complete search history.

(56) References Cited

U.S. PATENT DOCUMENTS

| | | | | |
|---|---|---|---|---|
| 3,819,860 | A | 6/1974 | Miller | |
| 4,548,082 | A | 10/1985 | Engebretson et al. | |
| 4,629,833 | A | 12/1986 | Kern et al. | |
| 4,677,679 | A | 6/1987 | Killion | |
| 4,763,753 | A | 8/1988 | Killion | |
| 4,870,688 | A | 9/1989 | Voroba et al. | |
| 5,193,116 | A | 3/1993 | Mostardo | |
| 5,222,050 | A | 6/1993 | Marren et al. | |
| 5,692,059 | A | 11/1997 | Kruger | |
| 5,887,070 | A | 3/1999 | Iseberg et al. | |
| 6,072,885 | A | 6/2000 | Stockham et al. | |
| 6,137,889 | A | 10/2000 | Shennib et al. | |
| 6,205,227 | B1 | 3/2001 | Mahoney et al. | |
| 6,263,085 | B1 * | 7/2001 | Weffer | 381/371 |
| 6,389,143 | B1 | 5/2002 | Leedom et al. | |
| 6,931,140 | B2 | 8/2005 | Van Halteren et al. | |
| 7,088,839 | B2 | 8/2006 | Geschiere et al. | |

(Continued)

OTHER PUBLICATIONS

Shambro, "Ultimate Sound, Ultimate Ears", http://homerecording.about.com/od/interviewstipstricks/a/ultimateears1.htm, 2009, pp. 1-7.

*Primary Examiner* — Huyen D Le
(74) *Attorney, Agent, or Firm* — Patent Law Office of David G. Beck

(57) ABSTRACT

A multi-driver, in-ear monitor is provided that is coupleable to an external audio source, for example via a source input cable or a wireless receiver. A circuit, for example comprising a passive or active crossover circuit, receives the electrical signal from the external audio source and provides separate input signals to the drivers contained within the in-ear monitor. A plurality of sound delivery tubes acoustically couple the audio output from each of the drivers to the acoustic output surface of the in-ear monitor. The in-ear monitor may be configured as a custom fit IEM or configured to accept a removable eartip. The plurality of sound delivery tubes may be comprised of a pair of concentric tubes; a pair of concentric tubes and a discrete tube; or three concentric tubes.

37 Claims, 17 Drawing Sheets

U.S. PATENT DOCUMENTS

| | | | | |
|---|---|---|---|---|
| 7,194,102 | B2 | 3/2007 | Harvey | |
| 7,194,103 | B2 | 3/2007 | Harvey | |
| 7,263,195 | B2 | 8/2007 | Harvey et al. | |
| 7,317,806 | B2 | 1/2008 | Harvey et al. | |
| 2002/0025055 | A1 | 2/2002 | Stonikas et al. | |
| 2006/0045297 | A1 | 3/2006 | Houssmann | |
| 2006/0133631 | A1 * | 6/2006 | Harvey et al. | 381/312 |
| 2006/0133636 | A1 * | 6/2006 | Harvey et al. | 381/380 |

* cited by examiner

IN-EAR MONITOR WITH CONCENTRIC SOUND BORE CONFIGURATION

CROSS-REFERENCE TO RELATED APPLICATION

This application claims the benefit of the filing date of U.S. Provisional Patent Application Ser. No. 61/276,172, filed Sep. 8, 2009, and the benefit of the filing date of U.S. Provisional Patent Application Ser. No. 61/281,645, filed Nov. 19, 2009, the disclosures of which are incorporated herein by reference for any and all purposes.

FIELD OF THE INVENTION

The present invention relates generally to audio monitors and, more particularly, to an in-ear monitor with multiple sound bores optimized for a multi-driver configuration.

BACKGROUND OF THE INVENTION

In-ear monitors, also referred to as canal phones and stereo earphones, are commonly used to listen to both recorded and live music. A typical recorded music application would involve plugging the monitor into a music player such as a CD player, flash or hard drive based MP3 player, home stereo, or similar device using the device's headphone socket. Alternately, the monitor can be wirelessly coupled to the music player. In a typical live music application, an on-stage musician wears the monitor in order to hear his or her own music during a performance. In this case, the monitor is either plugged into a wireless belt pack receiver or directly connected to an audio distribution device such as a mixer or a headphone amplifier. This type of monitor offers numerous advantages over the use of stage loudspeakers, including improved gain-before-feedback, minimization/elimination of room/stage acoustic effects, cleaner mix through the minimization of stage noise, increased mobility for the musician and the reduction of ambient sounds. Many of these same advantages may be gained by an audience member using an in-ear monitor to listen to a live performance.

In-ear monitors are quite small and are normally worn just outside the ear canal. As a result, the acoustic design of the monitor must lend itself to a very compact design utilizing small components. Some monitors are custom fit (i.e., custom molded) while others use a generic "one-size-fits-all" earpiece. Generic earpieces may include a removable and replaceable eartip sleeve that provides a limited degree of customization.

Prior art in-ear monitors use either diaphragm-based or armature-based receivers. Broadly characterized, a diaphragm is a moving-coil speaker with a paper or mylar diaphragm. Since the cost to manufacture diaphragms is relatively low, they are widely used in many common audio products (e.g., ear buds). In contrast to the diaphragm approach, an armature receiver utilizes a piston design. Due to the inherent cost of armature receivers, however, they are typically only found in hearing aids and high-end in-ear monitors.

Diaphragm receivers, due to the use of moving-coil speakers, suffer from several limitations. First, because of the size of the diaphragm assembly, a typical earpiece is limited to a single diaphragm. This limitation precludes achieving optimal frequency response (i.e., a flat or neutral response) through the inclusion of multiple diaphragms. Second, diaphragm-based monitors have significant frequency roll off above 4 kHz. As the desired upper limit for the frequency response of a high-fidelity monitor is at least 15 kHz, diaphragm-based monitors cannot achieve the desired upper frequency response while still providing accurate low frequency response.

Armatures, also referred to as balanced armatures, were originally developed by the hearing aid industry. This type of driver uses a magnetically balanced shaft or armature within a small, typically rectangular, enclosure. As a result of this design, armature drivers are not reliant on the size and shape of the enclosure, i.e., the ear canal, for tuning as is the case with diaphragm-based monitors. Typically, lengths of tubing are attached to the armature which, in combination with acoustic filters, provide a means of tuning the armature. A single armature is capable of accurately reproducing low-frequency audio or high-frequency audio, but incapable of providing high-fidelity performance across all frequencies.

To overcome the limitations associated with both diaphragm and armature drivers, some in-ear monitors use multiple armatures. In such multiple driver arrangements, a crossover network is used to divide the frequency spectrum into multiple regions, i.e., low and high or low, medium, and high. Separate, optimized drivers are then used for each acoustic region. If the monitor's earpiece is custom fit, generally a pair of delivery tubes delivers the sound produced by the drivers to the output face of the earpiece. Alternately, or if the earpiece is not custom fit, the outputs from the drivers are merged into a single delivery tube, the single tube delivering the sound from all drivers to the earpiece's output face.

SUMMARY OF THE INVENTION

A multi-driver, in-ear monitor is provided that is coupleable to an external audio source (e.g., audio receivers, audio mixers, music players, headphone amplifiers, DVD players, cellular telephones, handheld electronic gaming devices, etc.), for example via a source input cable (e.g., hard-wired or coupled to the IEM with a cable socket) or a wireless receiver (e.g., disposed within the in-ear monitor enclosure). A circuit, for example comprising a passive or active crossover circuit, receives the electrical signal from the external audio source and provides separate input signals to the drivers contained within the in-ear monitor. A plurality of sound delivery tubes acoustically couple the audio output from each of the drivers to the acoustic output surface of the in-ear monitor. The in-ear monitor may be configured as a custom fit IEM or configured to accept a removable eartip.

In at least one embodiment, the plurality of sound delivery tubes is comprised of two concentric sound delivery tubes; an inner sound delivery tube and an outer sound delivery tube. At least one driver is coupled to each of the two concentric sound delivery tubes. The IEM may further comprise a third sound delivery tube coupled to a third driver, where the third sound delivery tube is discrete from the two concentric sound delivery tubes. Acoustic filters may be used within the sound delivery tube(s) or interposed between the driver(s) and the corresponding sound delivery tube(s). A plurality of support members may be used to maintain the spacing between the two concentric sound delivery tubes.

In at least one embodiment, the plurality of sound delivery tubes is comprised of three concentric sound delivery tubes; an inner sound delivery tube, an outer sound delivery tube and a middle sound delivery tube interposed between the inner and outer tubes. At least one driver is coupled to each of the three concentric sound delivery tubes. Acoustic filters may be used within the sound delivery tube(s) or interposed between the driver(s) and the corresponding sound delivery tube(s). A plurality of support members may be used to maintain the spacing between the inner and middle concentric sound delivery tubes, and between the middle and outer concentric sound delivery tubes.

A further understanding of the nature and advantages of the present invention may be realized by reference to the remaining portions of the specification and the drawings.

DESCRIPTION OF THE SPECIFIC EMBODIMENTS

In the following text, the terms "in-ear monitor", "IEM", "canal phone", "earbud" and "earphone" may be used interchangeably. Similarly, the terms "custom" earphone, "custom fit" earphone and "molded" earphone may be used interchangeably and refer to an IEM that is molded to fit within the ear of a specific user. Similarly, the terms "sound delivery tube", "sound delivery bore" and "sound bore" may be used interchangeably. Unless otherwise noted, the term "driver" as used herein refers to either an armature driver or a diaphragm driver. It should be understood that identical element symbols used on multiple figures refer to the same component, or components of equal functionality. Additionally, the accompanying figures are only meant to illustrate, not limit, the scope of the invention and should not be considered to be to scale.

Figure 1:
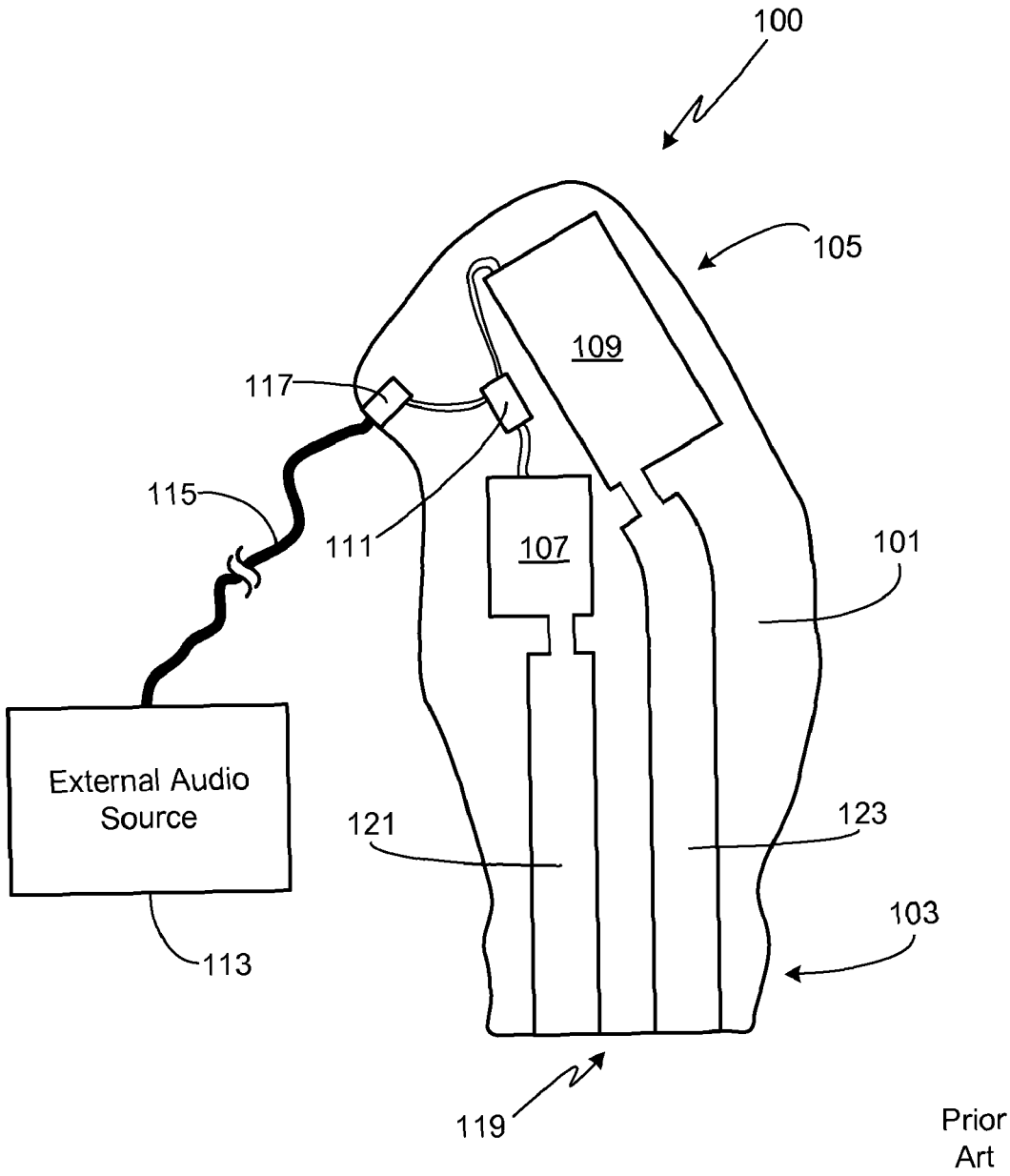
FIG. 1 illustrates the primary elements of a custom fit in-ear monitor according to the prior art.

FIG. 1 illustrates the primary elements of a custom fit in-ear monitor 100 according to the prior art. Being a custom fit IEM, enclosure 101 of monitor 100 is molded or otherwise custom fit to a particular ear of a specific end user. Typically enclosure 101 includes an ear canal portion 103 designed to fit within the outer ear canal of the user and an concha portion 105 designed to fit within the concha portion of the ear. In the illustrated example, monitor 100 includes a pair of armature drivers 107 and 109, driver 107 being a low-frequency driver and driver 109 being a high-frequency driver. A circuit 111, such as a passive crossover circuit or an active crossover circuit, provides input to armature drivers 107 and 109. Circuit 111, and therefore IEM 100, is coupled to an external audio source 113 via a cable 115, cable 115 transmitting electrical signals from audio source 113 to circuit 111, the electrical signals representative of the sound to be produced by IEM 100. Cable 115 is either hard-wired to IEM 100, or electrically connected to IEM 100 via a cable socket 117 that is integrated within enclosure 101. As used herein, the term "external audio source" refers to any of a variety of possible audio sources, all of which are external and independent of the IEM to which they are attached, and all of which produce electrical signals that are representative of the sound to be generated by the IEM. This is in distinct contrast to a hearing aid in which the audio source, i.e., one or more microphones and typically an audio amplifier/sound processor, is integrated within, and internal to, the hearing aid. Thus while a hearing aid allows the user to listen to an external source of sound, the hearing aid itself is not coupled to the external audio source. Exemplary external audio sources include, but are not limited to, audio receivers, audio mixers, music players, headphone amplifiers, DVD players, cellular telephones, and handheld electronic gaming devices. As is well known in the industry, in-ear monitor 100 may also be coupled, via cable 115, to a wireless receiver that wirelessly receives signals representative of the audio source from the combination of a wireless transmitter and the external audio source.

The output from drivers 107 and 109 is delivered to the end surface 119 of the IEM via a pair of delivery tubes 121 and 123, respectively. Because an IEM of this type is molded to fit the shape of the user's ear, and because the ear canal portion 103 of the earpiece is molded around the delivery tubes (or tube), this type of earpiece is large enough to accommodate a pair of delivery tubes as shown. Typical dimensions for sound delivery tubes, such as tubes 121 and 123, are an inside diameter (ID) of 1.9 millimeters and an outside diameter (OD) of 2.95 millimeters. Given that end surface 119 of a custom fit earpiece is approximately 9 millimeters by 11 millimeters, it is clear that such earpieces are sufficiently large for dual sound tubes. It will be appreciated that while sound delivery tubes 121 and 123 are shown as being straight, or substantially straight, IEM 100 will often use curved tubes to accommodate the contours of the ear canal to which the IEM is fit.

Custom fit earpieces typically provide better performance, both in terms of delivered sound fidelity and user comfort, than generic earpieces. Generic earpieces, however, are generally much less expensive as custom molds are not required and the earpieces can be manufactured in volume. In addition to the cost factor, generic earpieces are typically more readily accepted by the general population since many people find it both too time consuming and somewhat unnerving to have to go to a specialist, such as an audiologist, to be fitted for a custom earpiece.

Figure 2:
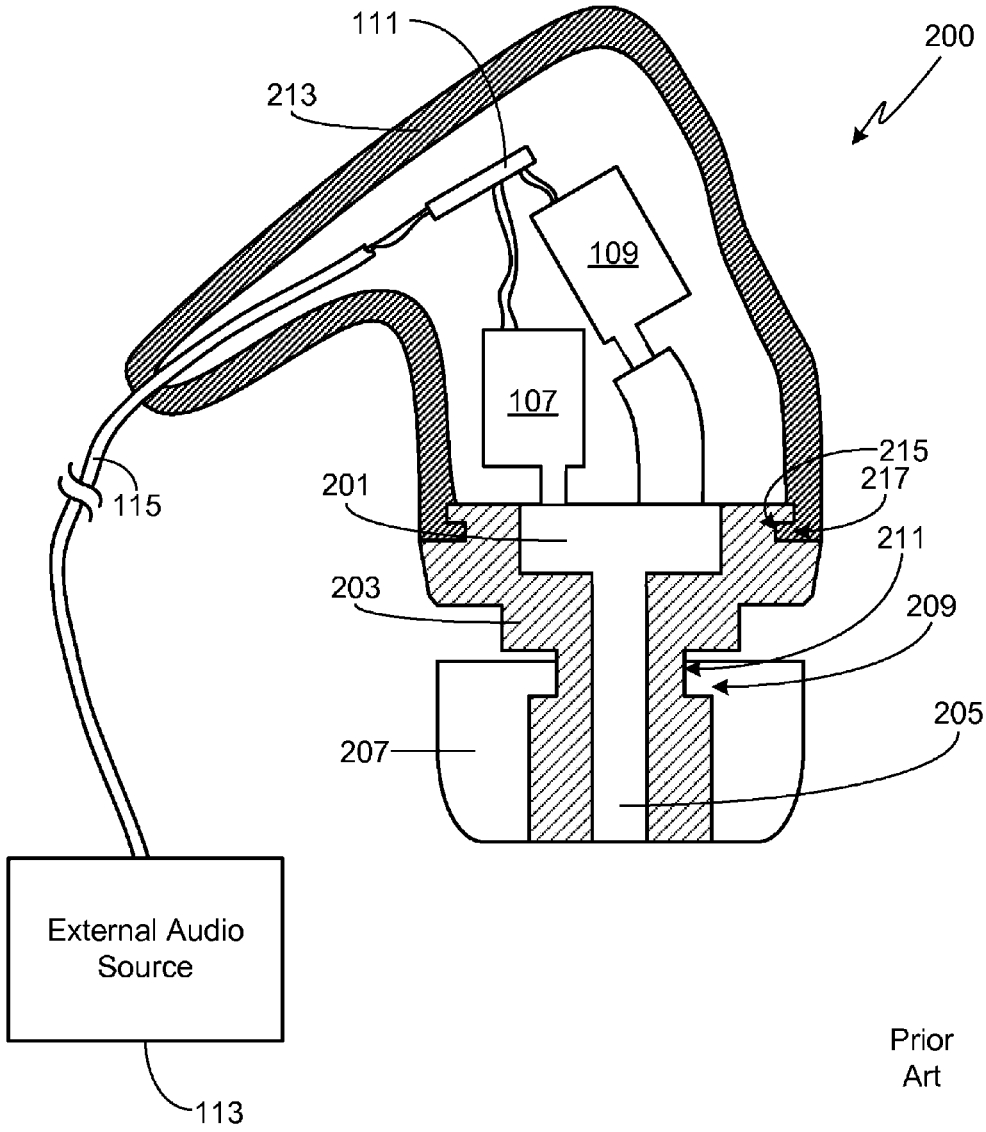
FIG. 2 illustrates the primary elements of a generic in-ear monitor according to the prior art.

FIG. 2 illustrates the primary elements of a generic IEM 200 in accordance with the prior art. As in the prior example, monitor 200 includes a pair of drivers 107/109, a crossover circuit 111, and a cable 115 that couples IEM 200 to external audio source 113. The output from each driver enters an acoustic mixing chamber 201 within sound delivery member 203. A single sound delivery tube 205 delivers the mixed audio from the two drivers through the sound delivery member 203 to the user. Sound delivery member 203 is designed to fit within the outer ear canal of the user and as such, is generally cylindrical in shape.

Attached to the end portion of sound delivery member 203 is an eartip 207, also referred to as an eartip sleeve or simply a sleeve. Eartip 207 can be fabricated from any of a variety of materials including foam, plastic and silicon-based material. Sleeve 207 can have the generally cylindrical and smooth shape shown in FIG. 2, or can include one or more flanges. To hold sleeve 207 onto member 203 during normal use but still allow the sleeve to be replaced when desired, typically the eartip includes a lip portion 209 which is fit into a corresponding channel or groove 211 in sound delivery member 203. The combination of an interlocking groove 211 with a lip 209 provides a convenient means of replacing eartip 207, allowing sleeves of various sizes, colors, materials, material characteristics (density, compressibility), or shape to be easily attached to in-ear monitor 200. As a result, it is easy to provide the end user with a comfortable fit at a fraction of the cost of a custom fit earpiece. Additionally, the use of interlocking members 209 and 211 allow worn out eartips to be quickly and easily replaced. It will be appreciated that other eartip mounting methods can be used with earpiece 200. For example, eartip 207 can be attached to sound delivery member 203 using pressure fittings, bonding, etc.

An outer earpiece enclosure 213 attaches to sound delivery member 203. Earpiece enclosure 213 protects drivers 107/109 and any required earpiece circuitry (e.g., crossover circuit 111) from damage while providing a convenient means of securing cable 115 to the in-ear monitor. Enclosure 213 can be attached to member 203 using interlocking members (e.g., groove 215, lip 217). Alternately, an adhesive or other means can be used to attach enclosure 213 to member 203. Enclosure 213 can be fabricated from any of a variety of materials, thus allowing the designer and/or user to select the material's firmness (i.e., hard to soft), texture, color, etc. Enclosure 213 can either be custom molded or designed with a generic shape.

Figure 3:
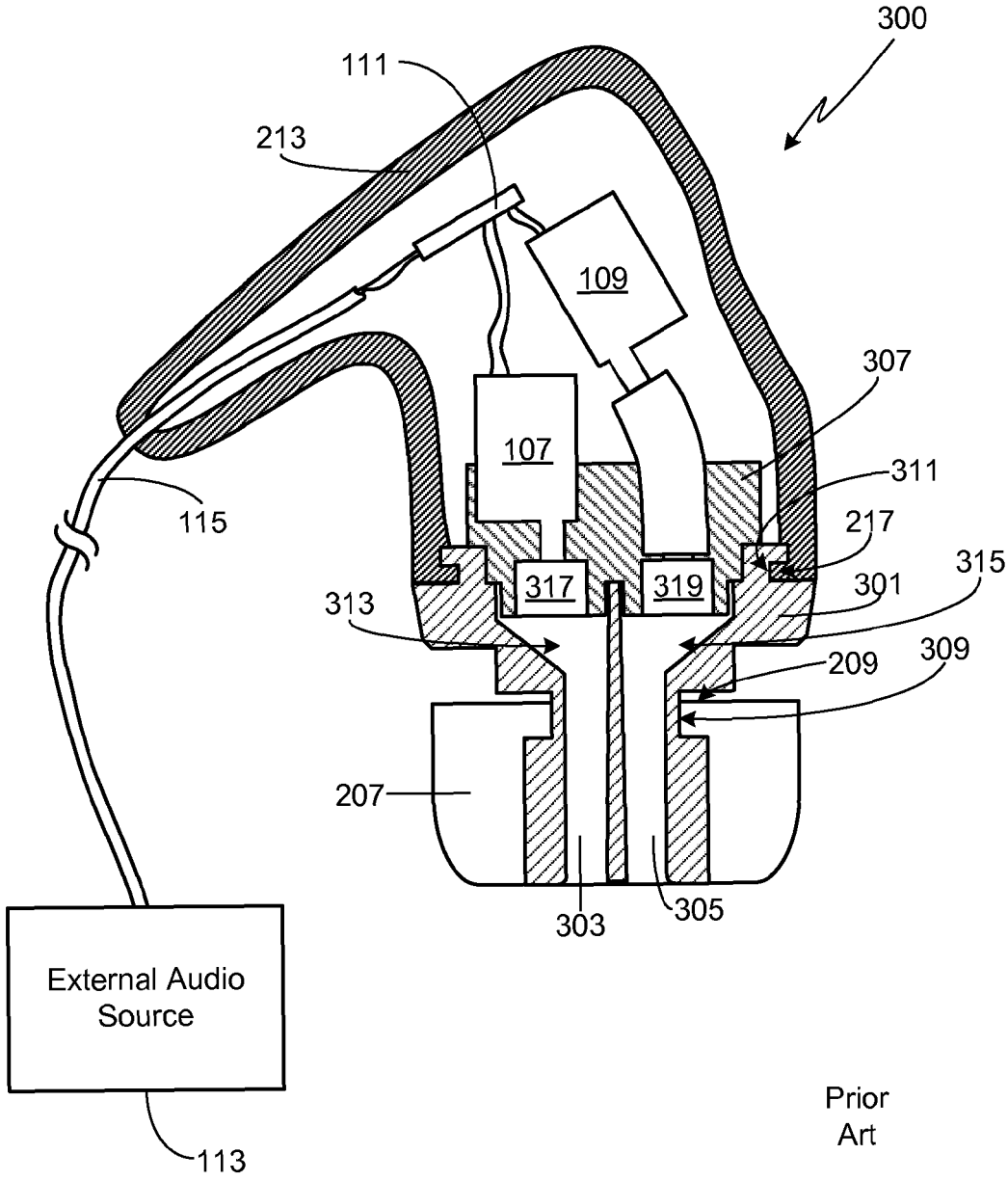
FIG. 3 illustrates the primary elements of a dual bore in-ear monitor according to the prior art.

FIG. 3 illustrates the primary elements of a dual bore in-ear monitor 300 in accordance with the prior art. As shown, in addition to the previously described components, sound delivery member 301 of earpiece 300 includes two separate sound delivery tubes 303/305, corresponding to drivers 107 and 109, respectively. Preferably sound delivery member 301 is molded, thus permitting sound delivery tubes 303/305 to be easily fabricated within the member. Also preferably a boot member 307 attaches to sound delivery member 301, boot member 307 securing the components to the sound delivery member while still providing a means of including acoustic filters as described more fully below. As with the in-ear monitor illustrated in FIG. 2, monitor 300 includes a removable sleeve 207 (e.g., foam sleeve, silicon sleeve, flanged sleeve, etc.) which is attached by interlocking sleeve lip 209 onto groove 309 of member 301. Similarly, monitor 300 includes a housing enclosure 213 coupled to member 301 using interlocking members (e.g., groove 311, lip 217)

In the in-ear monitor illustrated in FIG. 3, sound delivery tubes 303/305 include transition regions 313/315, respectively. Regions 313/315 redirect the sound emitted by the drivers to the two delivery tubes 303/305, thus insuring that the tubes pass through the small ID of member 301, in particular the necked down region of member 301 corresponding to groove 309. Also shown is an acoustic damper 317 interposed between driver 107 and sound tube 303, and a second acoustic damper 319 interposed between driver 109 and sound tube 305. The use of dampers allows the output from the in-ear monitor 300 in general, and the output from either driver in particular, to be tailored. Tailoring may be used, for example, to reduce the sound pressure level overall or to reduce the levels for a particular frequency range or from a particular driver.

Figure 4:
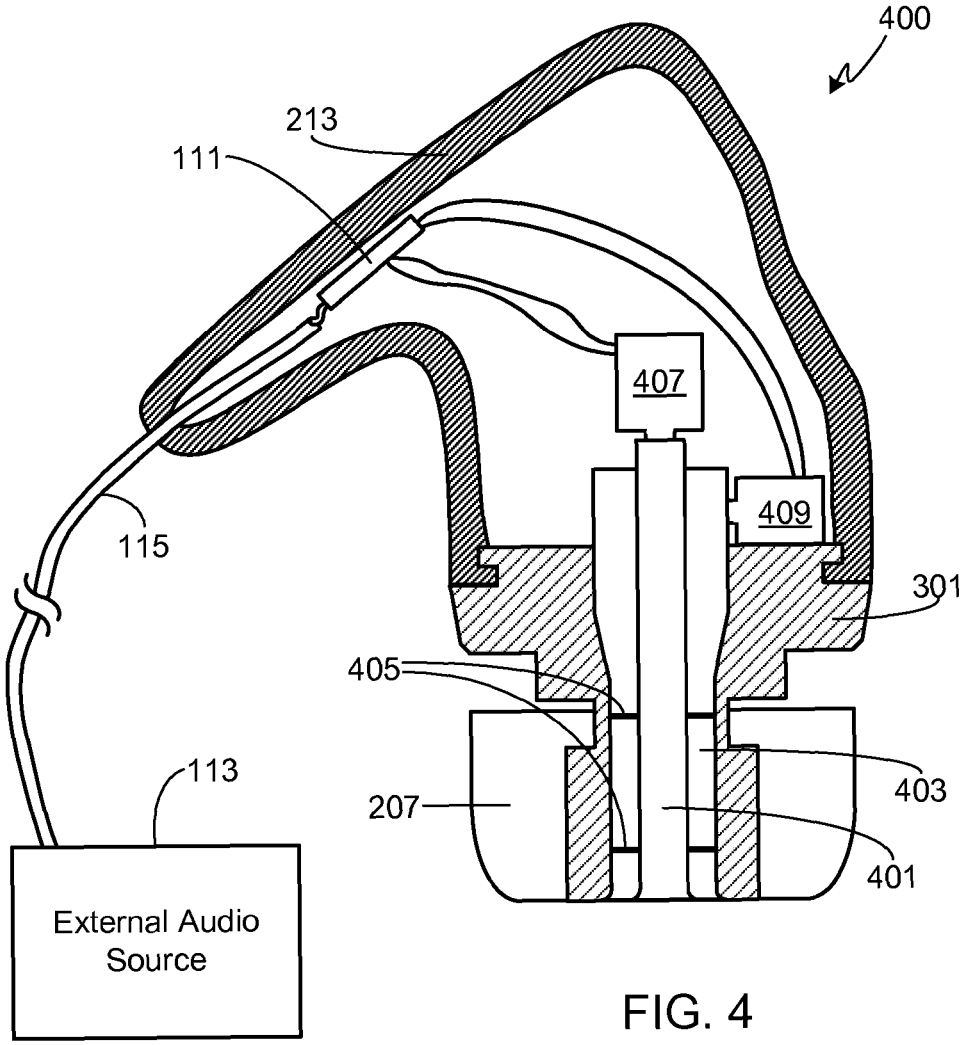
FIG. 4 illustrates the primary elements of a preferred embodiment of the invention, this embodiment including a pair of concentric sound delivery tubes.
Figure 5:
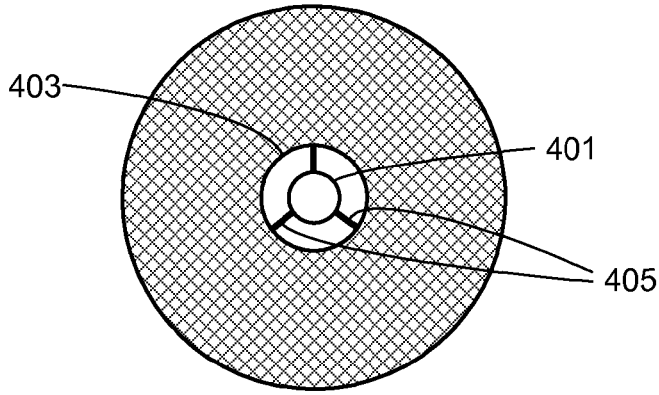
FIG. 5 provides an end view of the acoustic output surface of the IEM shown in FIG. 4.

FIG. 4 illustrates the primary elements of a preferred embodiment of the invention that includes a pair of concentric sound delivery tubes. As shown, instead of using a pair of side-by-side sound delivery tubes, as shown in FIG. 3, a pair of concentric sound delivery tubes 401/403 is used. Inner sound delivery tube 401 is held in place, and apart from sound delivery tube 403, with one or more support members 405 (e.g., support struts). Support members 405 are designed to support inner bore 401 without significantly occluding outer tube 403, or significantly impacting the quality of the sound passing through outer tube 403. A first driver 407, preferably an armature driver, is acoustically coupled to inner sound delivery tube 401. A second driver 409, preferably an armature driver, is acoustically coupled to outer sound delivery tube 403. Drivers 407 and 409 preferably generate sounds in two different frequency ranges that may, or may not, overlap. In at least one configuration, driver 407 is a high frequency driver and driver 409 is a mid or low frequency driver. It will be appreciated that other configurations may be used. As shown, the input for each of the two sound delivery tubes is separate and the two sound delivery tubes are acoustically isolated from one another. FIG. 5 provides an end view of the acoustic output surface of IEM 400, this view illustrating the output apertures of concentric sound delivery tubes 401 and 403. For the sake of clarity, this view also includes support struts/members 405.

Due to the use of concentric sound delivery tubes, the present invention allows the sound from the individual drivers to be delivered on-axis, rather than side by side as in monitor 300, thereby improving the phase relationship between the two sources. Additionally, this approach allows this phase relationship to be achieved without mixing the output from the individual drivers, as in monitor 200.

Although not shown, it will be appreciated that an acoustic damper can be interposed between driver 407 and sound delivery tube 401, or within sound delivery tube 401. Similarly, an acoustic damper can be interposed between driver 409 and sound delivery tube 403, or within sound delivery tube 403. Additionally, it will be appreciated that the output from each driver as well as the phase relationship between the two drivers may be tuned by varying the length of the sound tubes and the positions of the driver outputs relative to one another. Lastly, while IEM 400 is shown hard-wired to cable 115, it will be appreciated that cable 115 may be connected to the IEM using a jack/socket arrangement as previously described relative to IEM 100, or coupled to the external audio source via a wireless receiver as described further below.

Figure 6:
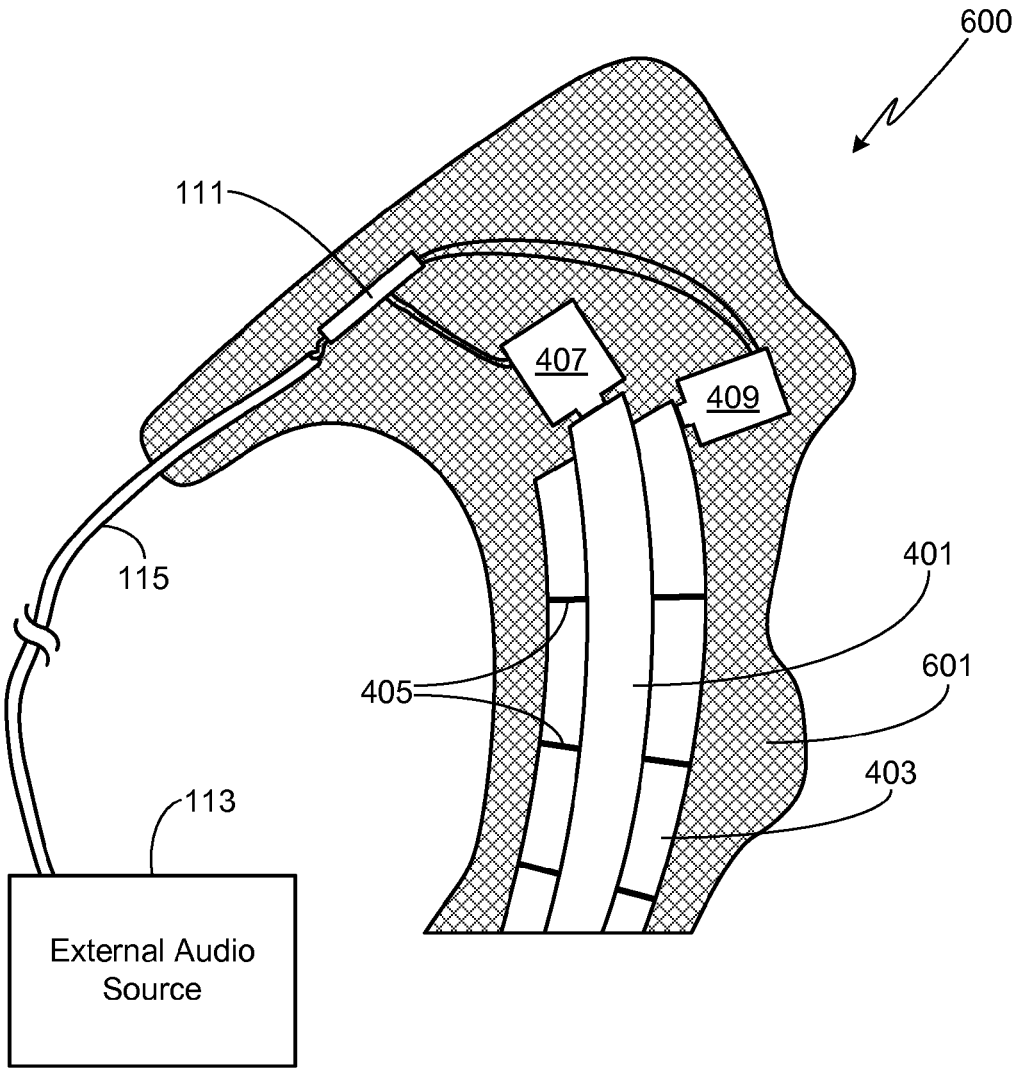
FIG. 6 illustrates the configuration shown in FIGS. 4 and 5, modified for use with a custom fit IEM.

While the use of dual concentric sound delivery tubes is shown implemented in a generic IEM in FIGS. 4 and 5, it will be appreciated that the same configuration is equally applicable to a custom fit IEM. For example, FIG. 6 illustrates the same configuration as shown in FIGS. 4 and 5, adapted for use in a custom IEM 600 in which the enclosure 601 is molded or otherwise custom fit to a specific end user. Cable 115 may be either hard-wired to IEM 600 as shown, or connected via a jack/socket arrangement as previously described. Additionally, IEM 600 may be coupled to the external audio source via a wireless receiver as described below. It will be appreciated that the curvature of concentric sound delivery tubes 401 and 403 as well as the exact locations of the internal components (e.g., drivers 407/409, crossover circuit 111, etc.) depend on the molded shape of enclosure 601. Note that due to the removal of the eartip, the custom fit configuration of IEM 600 allows the sound tubes to have a greater diameter while still achieving the same overall outside diameter at the audio output end of the IEM.

Figure 7:
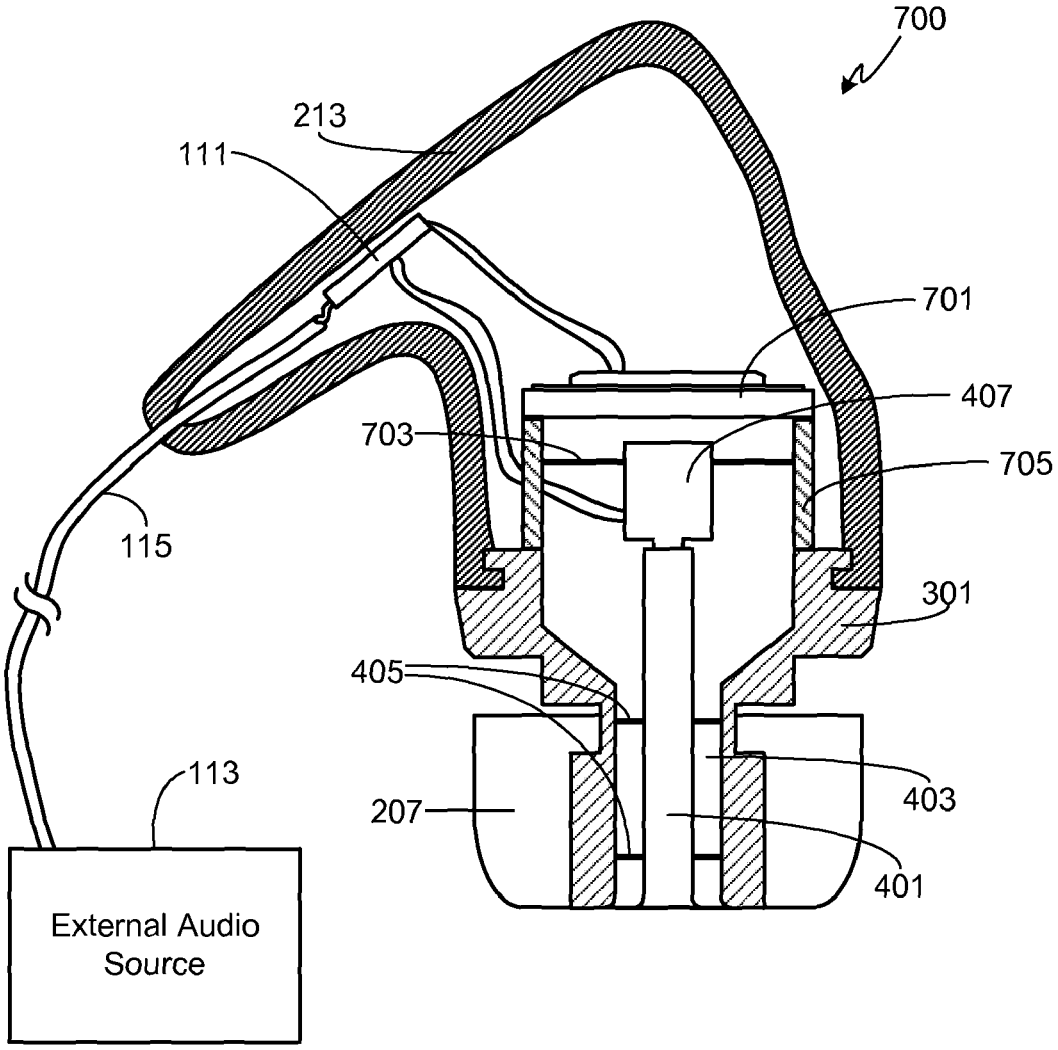
FIG. 7 illustrates the configuration shown in FIG. 4 utilizing an armature driver and a diaphragm driver.
Figure 8:
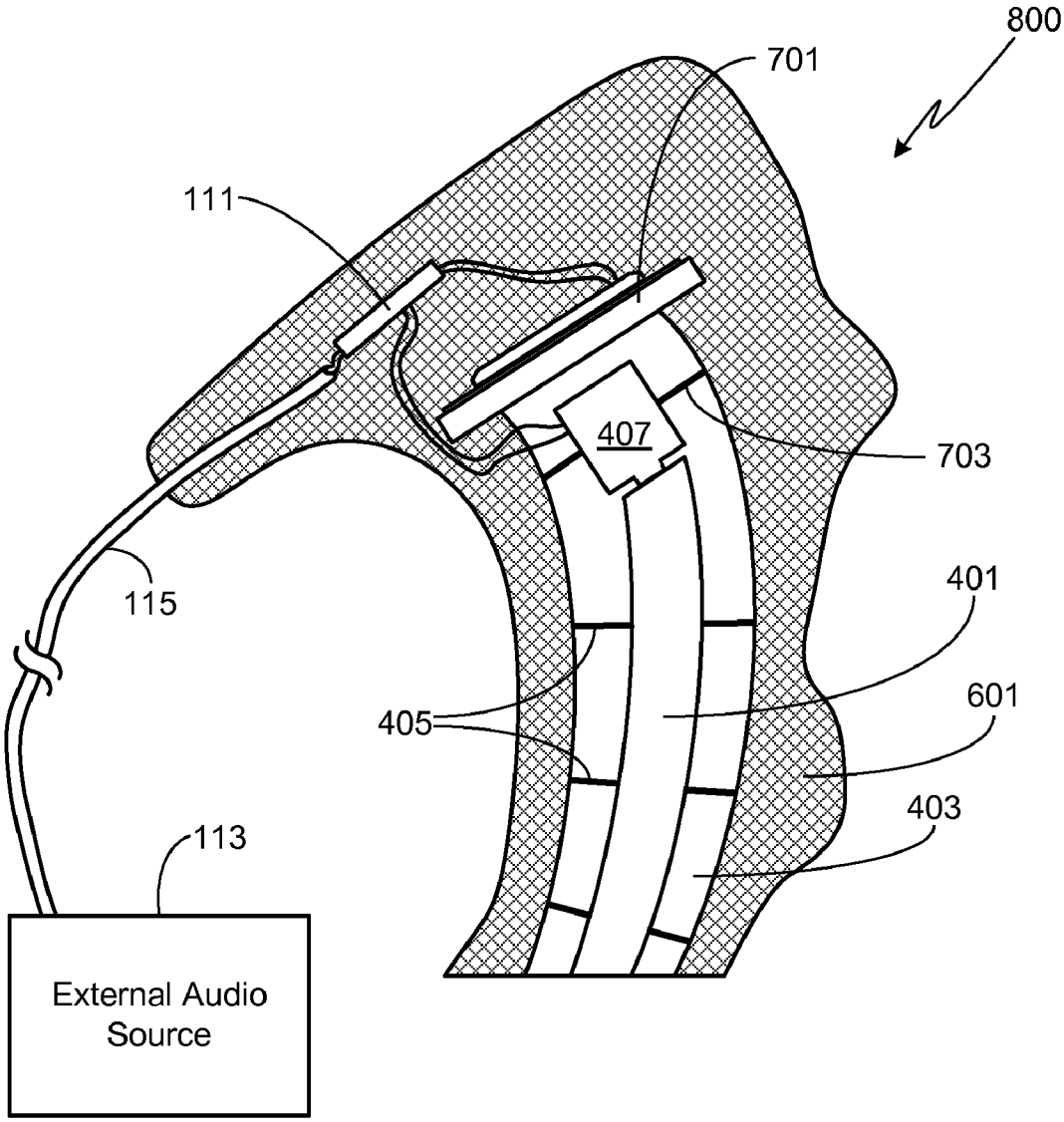
FIG. 8 illustrates the configuration shown in FIG. 6 utilizing an armature driver and a diaphragm driver.

In the above-illustrated embodiments of the invention, a pair of armature drivers 407/409 is used. It should be understood, however, that the present invention is not limited to this combination of drivers. For example, FIGS. 7 and 8 employ the same basic configuration as shown in FIGS. 4 and 6, respectively, but replace armature driver 409 with a diaphragm driver 701. Note that as shown, driver 407 is supported by support members 703 (e.g., support struts), support members 703 being designed to support driver 407 without significantly occluding tube 403, or significantly impacting the quality of the sound delivered by driver 701. In this configuration, driver 701 is supported by a support structure 705 and feeds into outer sound delivery tube 403. Although the overall approach and the sonic benefits remain unchanged in this configuration, the previous approach (as shown in FIGS. 4 and 6) offer packaging benefits since, in general, an armature driver is smaller than a diaphragm driver.

In another modification of the previously described embodiment, a pair of drivers is coupled to one, or both, of the concentric sound delivery tubes. This approach allows the benefits of one or more additional drivers to be gained while still achieving the sonic benefits associated with the dual, concentric sound delivery tubes. Thus, for example, if three drivers are used, the sound spectrum can be divided into three regions; e.g., high frequency, mid frequency and low frequency. The use of four drivers allows further division of the spectrum, or reinforcement of one particular frequency region (e.g., the low frequency). Although the use of both diaphragm and armature drivers may be used in such a combination, typically an all-armature configuration is preferred due to the smaller size of the armature drivers and the size constraints of the IEM.

Figure 9:
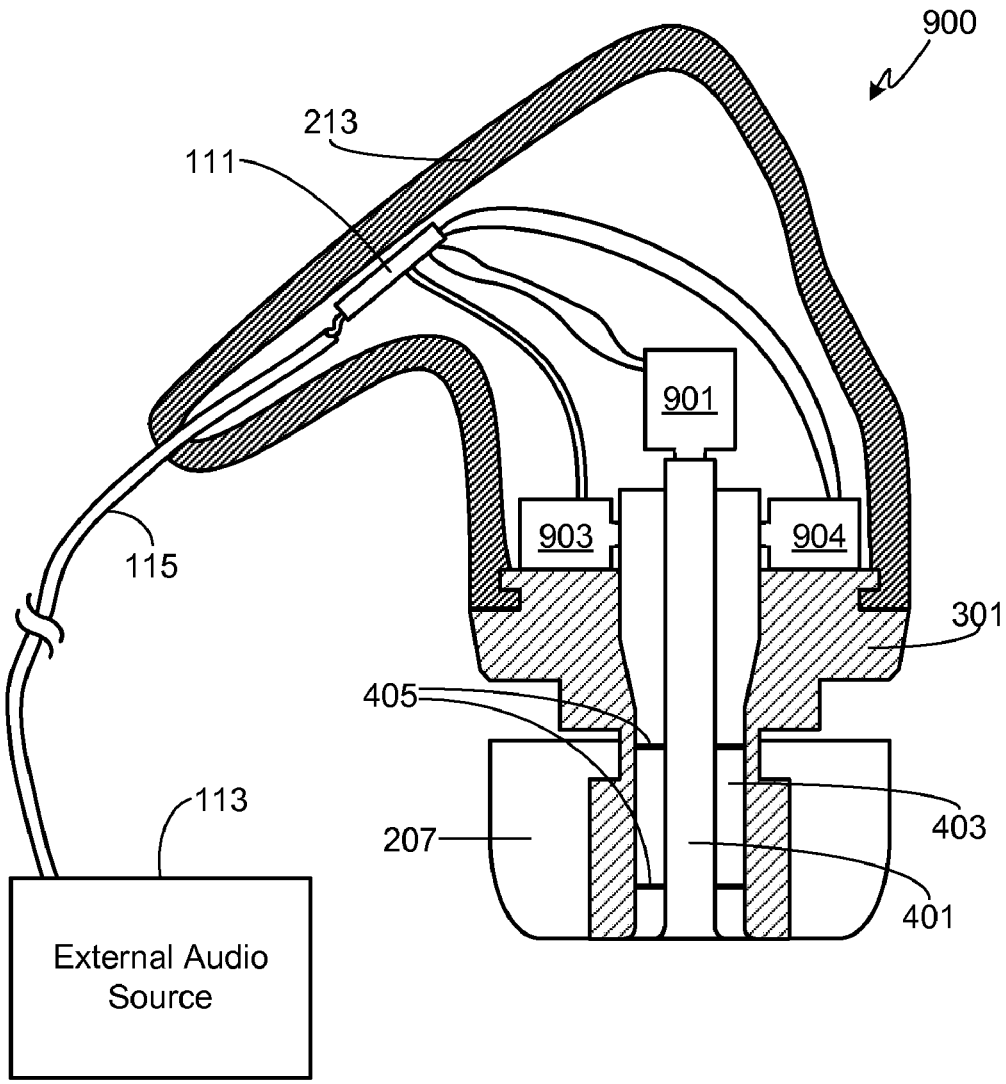
FIG. 9 illustrates the configuration shown in FIG. 4 utilizing three armature drivers, one coupled to the inner sound bore and two coupled to the outer, concentric sound delivery tube.
Figure 10:
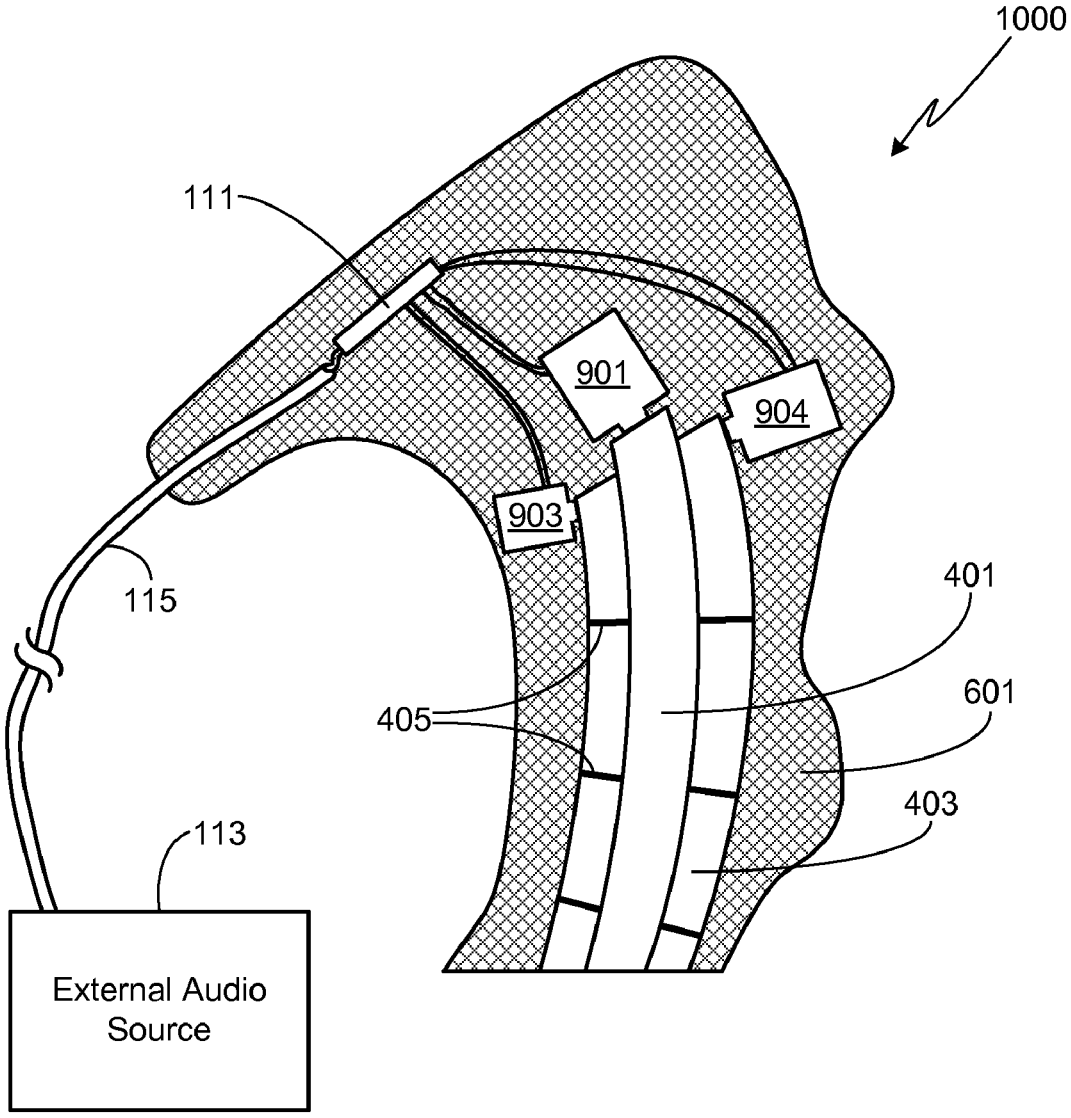
FIG. 10 illustrates the configuration shown in FIG. 6 utilizing three armature drivers, one coupled to the inner sound bore and two coupled to the outer, concentric sound delivery tube.

FIGS. 9 and 10 illustrate the use of three armature drivers with either a generic IEM 900 or a custom fit IEM 1000. In IEMs 900 and 1000, one driver 901 is coupled to inner sound delivery tube 401 and a pair of drivers 903/904 are coupled to outer concentric sound delivery tube 403. It should be understood that this configuration may be reversed, i.e., coupling two drivers to the inner bore 401 and the single driver to the outer concentric tube 403.

Figure 11:
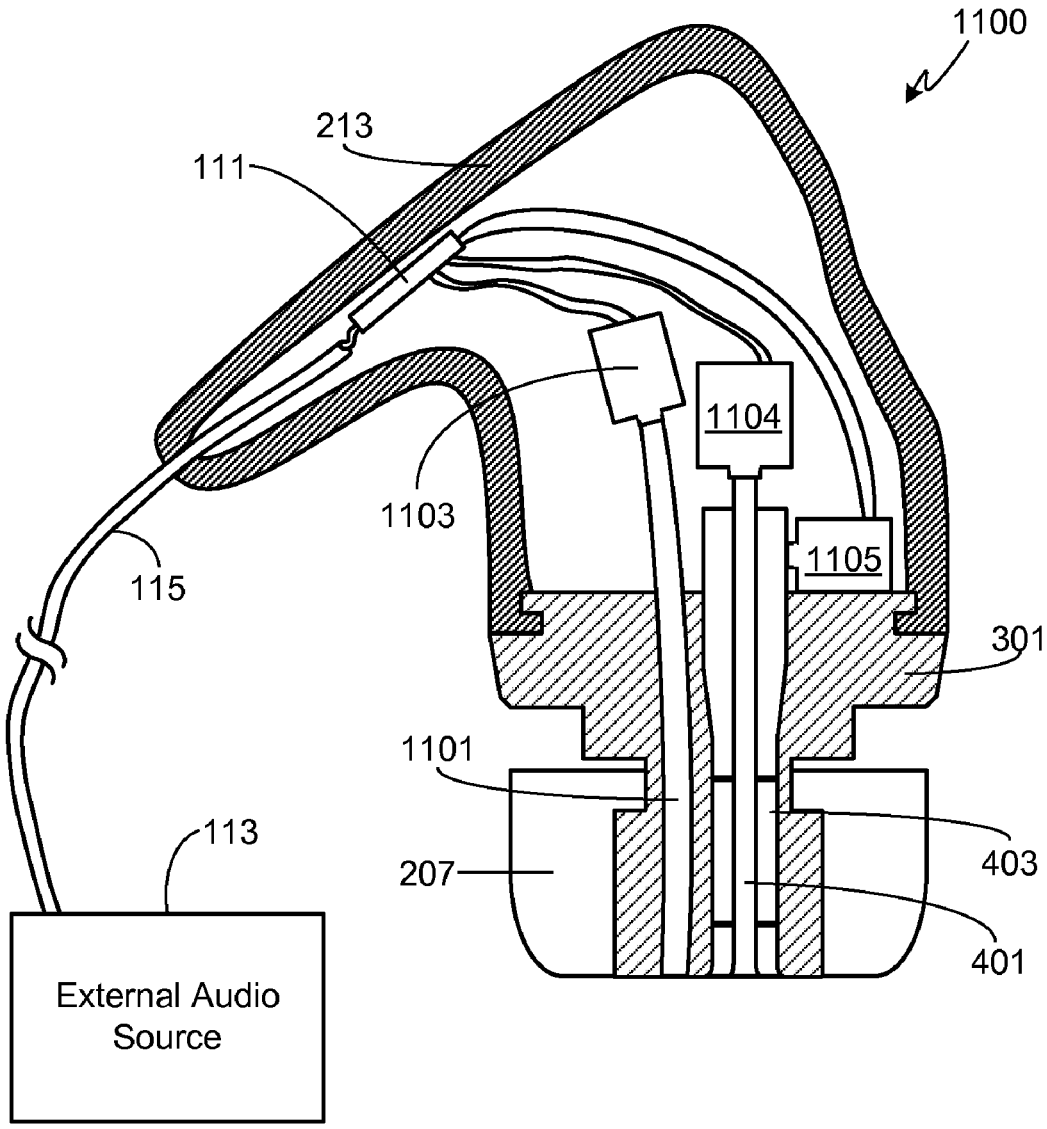
FIG. 11 illustrates the primary elements of an embodiment of the invention based on a generic IEM with a pair of concentric sound delivery tubes along with a single, discrete sound tube.
Figure 12:
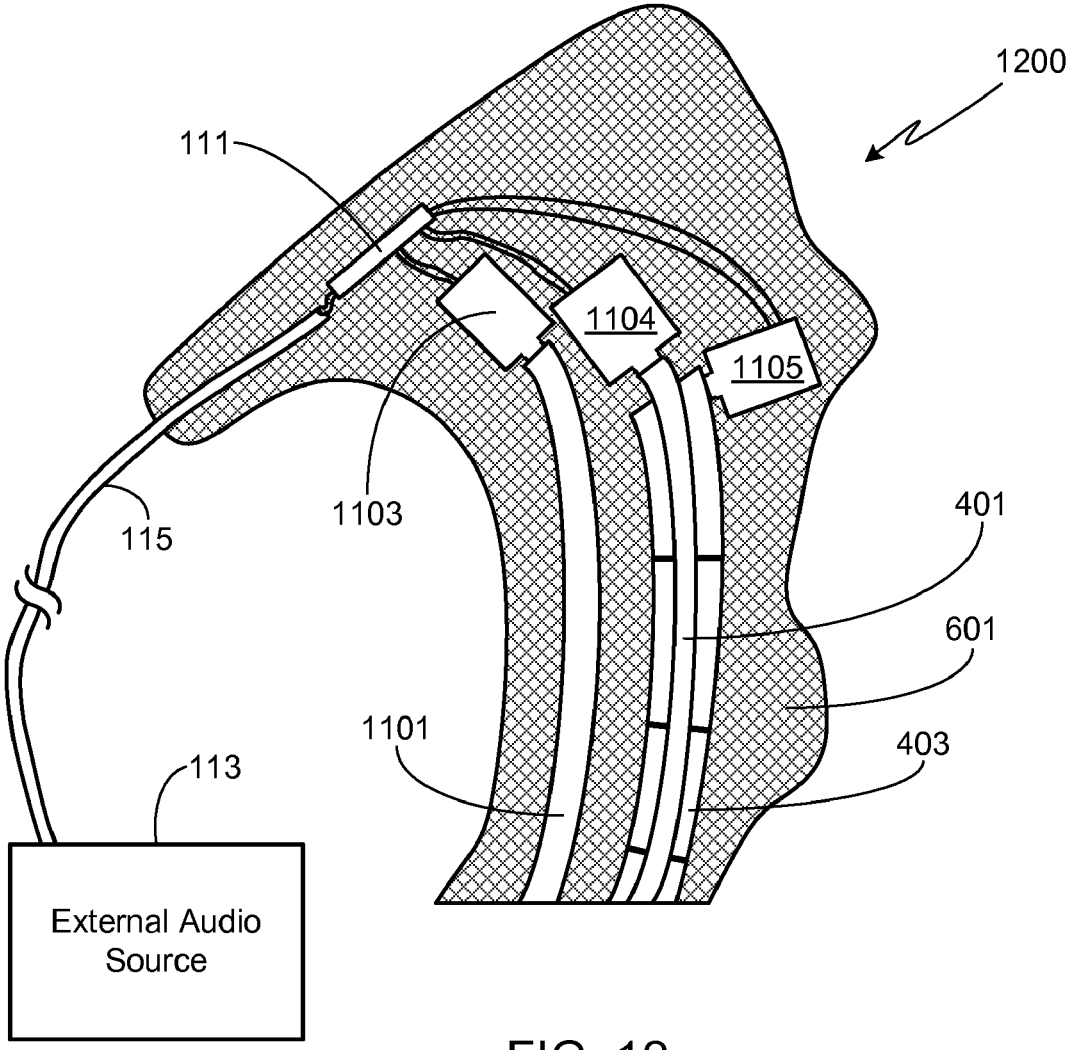
FIG. 12 illustrates the primary elements of an embodiment of the invention based on a custom fit IEM with a pair of concentric sound delivery tubes along with a single, discrete sound tube.
Figure 13:
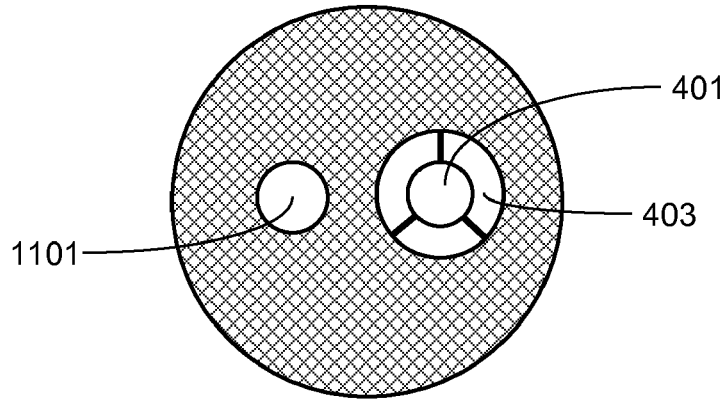
FIG. 13 provides an end view of the acoustic output surface of the IEMs shown in FIGS. 11 and 12.

In the embodiments illustrated above, a single pair of concentric sound delivery tubes is used. It will be appreciated, however, that a single IEM may utilize more than one pair of concentric sound delivery tubes. Alternately, and as illustrated in FIGS. 11-13, an IEM may include the dual concentric sound delivery tubes 401/403 as described above along with a single, discrete sound delivery tube 1101. Preferably these three sound delivery tubes are acoustically coupled to three armature drivers 1103-1105 as shown. In at least one configuration, driver 1104 is a high frequency driver; driver 1105 is a mid-frequency driver; and driver 1103 is a low frequency driver. Other driver/sound bore configurations are clearly envisioned by the inventor.

In a modification of the IEMs shown in FIGS. 11 and 12, one or more of the sound delivery tubes are coupled to multiple drivers, for example as described relative to the three driver/two bore IEMs shown in FIGS. 9 and 10. Additionally, and as previously noted relative to other embodiments of the invention, a combination of diaphragm and armature drivers may be used and the IEM's circuitry may be coupled to the external audio source wirelessly or with cable 115 (hard-wired or coupled to the IEM via a jack/socket arrangement). Note that FIG. 13 provides an end view of the acoustic output surface of either IEM 1100 or 1200, this view showing the output apertures of concentric sound delivery tubes 401/403 along with the output aperture of sound tube 1101.

Figure 14:
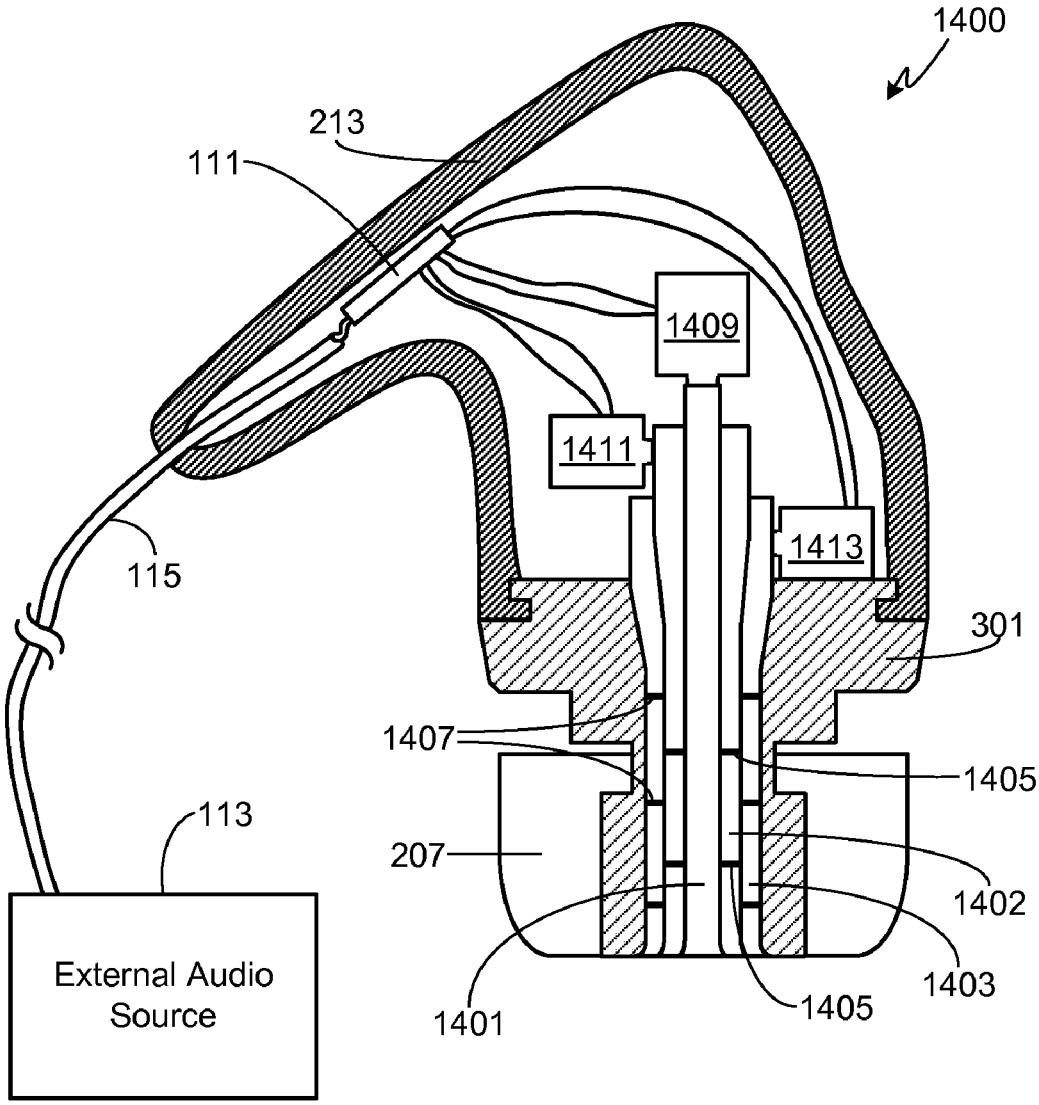
FIG. 14 illustrates the primary elements of a preferred embodiment of the invention based on a generic IEM utilizing three concentric sound delivery tubes.
Figure 15:
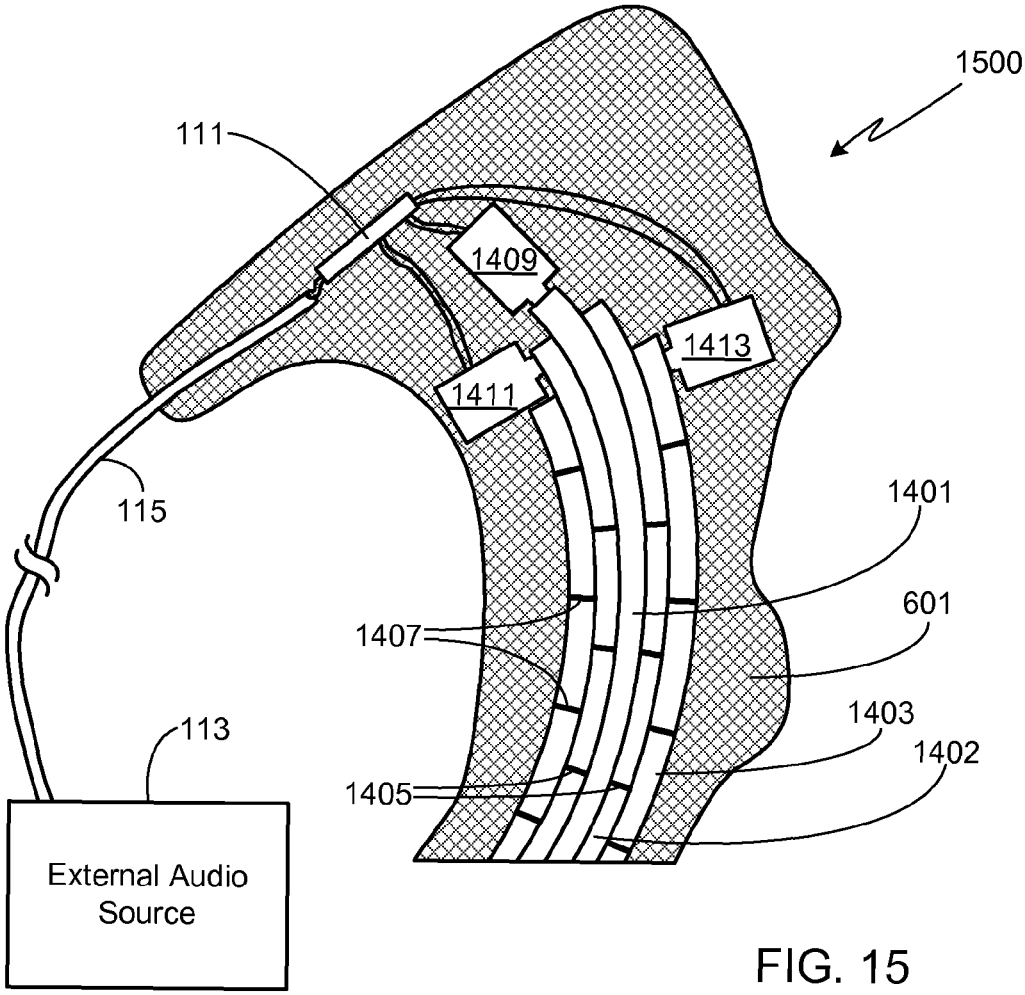
FIG. 15 illustrates the primary elements of a preferred embodiment of the invention based on a custom fit IEM utilizing three concentric sound delivery tubes.
Figure 16:
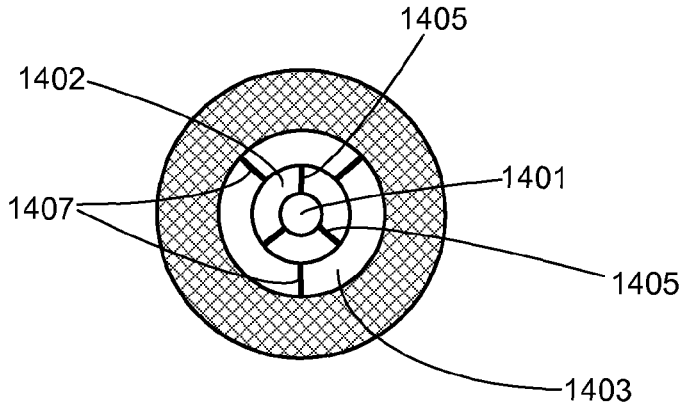
FIG. 16 provides an end view of the acoustic output surface of the IEMs shown in FIGS. 14 and 15.

FIGS. 14-16 illustrate another preferred, triple bore embodiment of the invention. As shown, IEM 1400 utilizes a generic eartip and IEM 1500 utilizes a custom fit configuration, with both IEMs including three, concentric sound bores 1401-1403 (i.e., inner sound delivery tube 1401, middle sound delivery tube 1402 and outer sound delivery tube 1403). Inner sound delivery tube 1401 is spaced apart from sound delivery tube 1402 using a plurality of support struts/members 1405. Similarly, sound delivery tube 1402 is spaced apart from sound delivery tube 1403 using a plurality of support struts/members 1407. As illustrated, sound delivery tube 1401 is coupled to the output of an armature driver 1409; sound delivery tube 1402 is coupled to the output of an armature driver 1411; and sound delivery tube 1403 is coupled to the output of an armature driver 1413. Preferably, driver 1409 is a high frequency driver; driver 1411 is a mid-frequency driver; and driver 1413 is a low frequency driver. Other driver/sound bore configurations are clearly envisioned by the inventor. FIG. 16 provides an end view of the acoustic output surface of either IEM 1400 or 1500, this view showing the output apertures of concentric sound delivery tubes 1401-1403. This view also shows support struts/members 1405 and 1407. As in the prior embodiments, it will be appreciated that IEMs 1400 and 1500 may also utilize a combination of diaphragm and armature drivers; that more than one driver may be coupled to any or all sound delivery tubes 1401-1403; and that the IEM's circuitry may be coupled to the external audio source wirelessly or with cable 115 (hard-wired or coupled to the IEM via a jack/socket arrangement).

Figure 17:
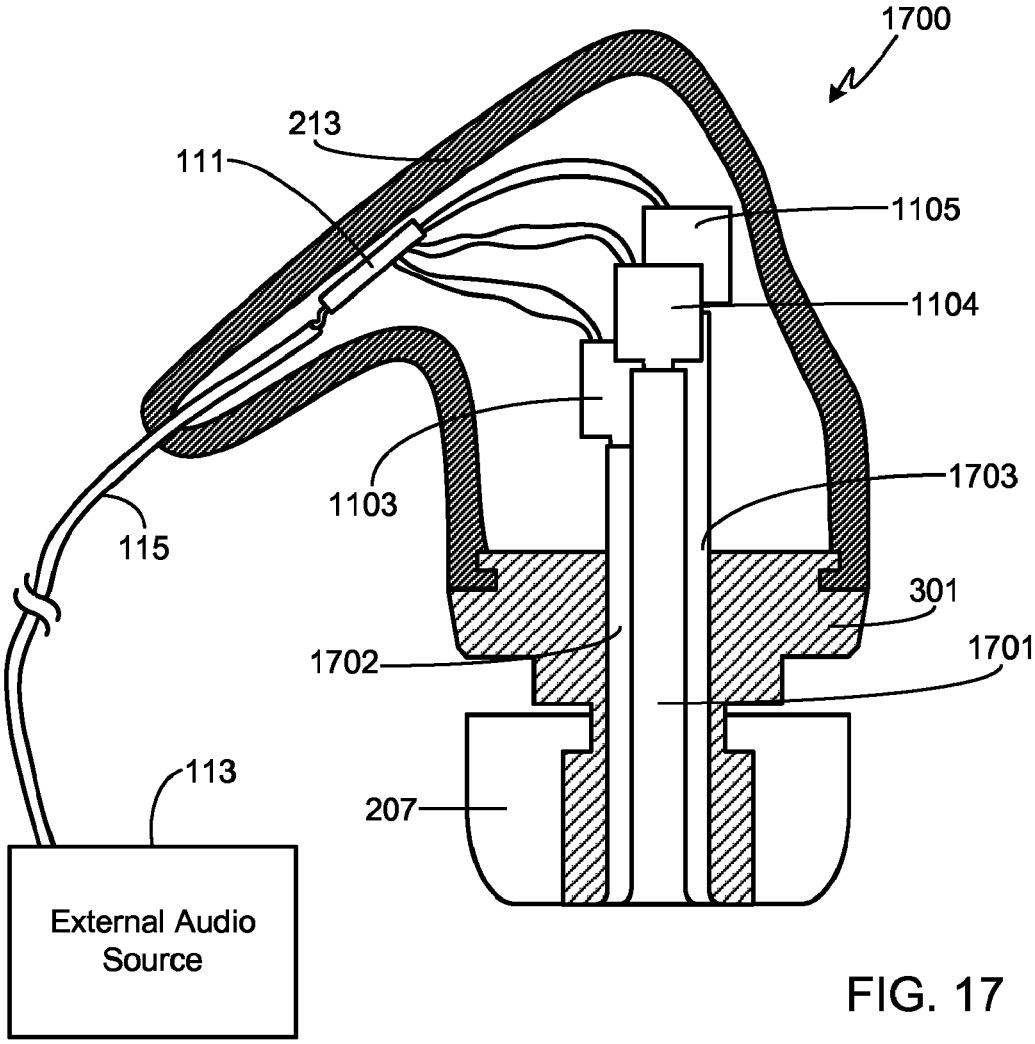
FIG. 17 illustrates the primary elements of a preferred embodiment of the invention based on a generic IEM utilizing three independent sound delivery tubes.
Figure 18:
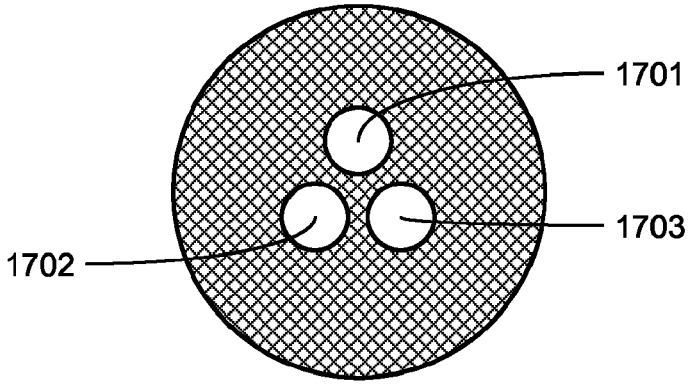
FIG. 18 provides an end view of the acoustic output surface of the IEM shown in FIG. 17.
Figure 19:
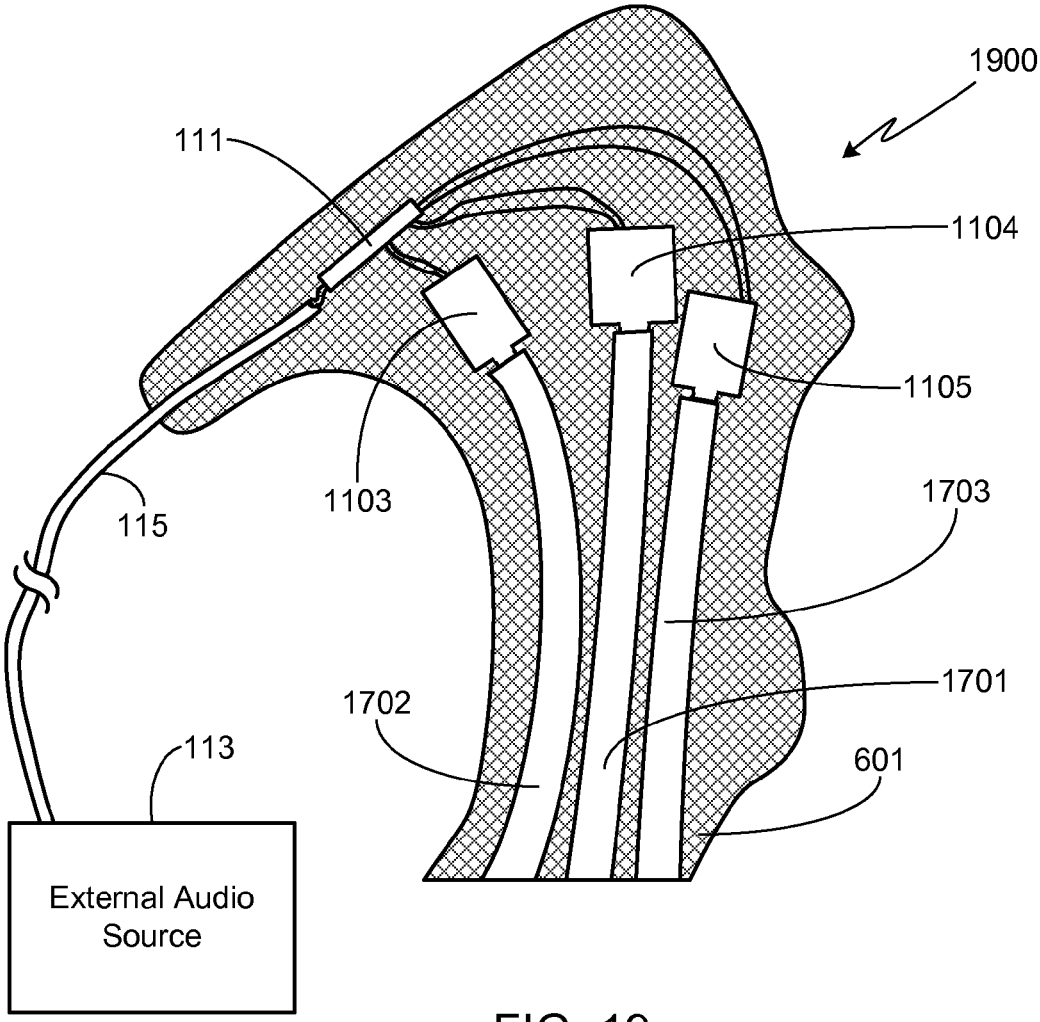
FIG. 19 illustrates the primary elements of a preferred embodiment of the invention based on a custom fit IEM utilizing three independent sound delivery tubes.
Figure 20:
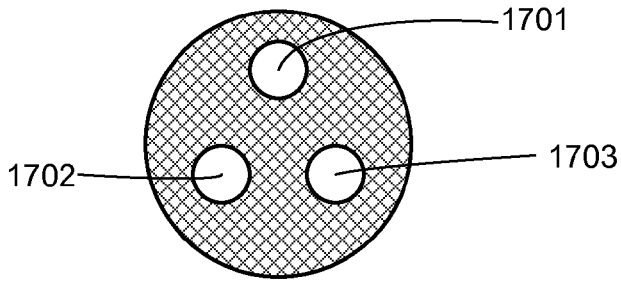
FIG. 20 provides an end view of the acoustic output surface of the IEM shown in FIG. 19.

In addition to the triple bore arrangements illustrated in FIGS. 11-16 and described above, it will be appreciated that the invention can also utilize three, distinct sound delivery tubes. For example, FIG. 17 illustrates a generic IEM 1700 that includes sound delivery tubes 1701-1703. FIG. 18 provides an end view of the acoustic output surface of IEM 1700, including the output apertures of sound delivery tubes 1701-1703. This same sound bore configuration is shown in FIGS. 19 and 20 for a custom-fit IEM 1900. As in the prior embodiments, it will be appreciated that IEMs 1700 and 1900 may also utilize a combination of diaphragm and armature drivers; that more than one driver may be coupled to any or all sound delivery tubes 1701-1703; and that the IEM's circuitry may be coupled to the external audio source wirelessly or with cable 115 (hard-wired or coupled to the IEM via a jack/socket arrangement). Additionally, it should be understood that these embodiments, as in the previously described embodiments, may utilize dampers/acoustic filters within the sound tubes or interposed between the drivers and the corresponding sound tubes.

Figure 21:
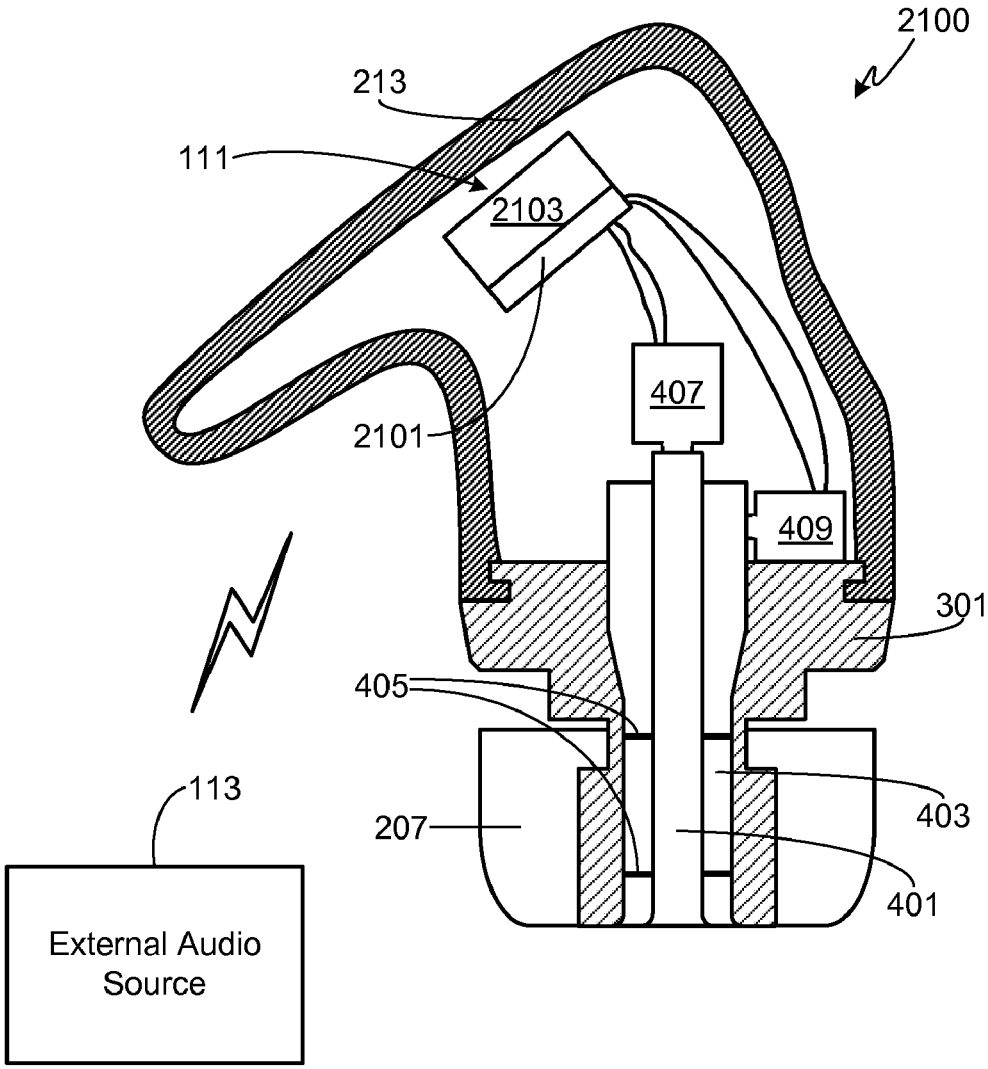
FIG. 21 illustrates the primary elements of a preferred embodiment of the invention based on a generic IEM and utilizing an internal wireless receiver.

As noted above, in a typical arrangement utilizing any of the previously described embodiments of the invention, the IEM's circuitry (e.g., circuit 111) is coupled to external audio source 113 using cable 115, cable 115 either hard-wired to the IEM enclosure, or coupled to the IEM enclosure using a jack/socket arrangement. While cable 115 may be coupled to a wireless receiver which, in turn, is wirelessly coupled to the external audio source, in at least one configuration, a wireless receiver is built into the IEM enclosure, thereby eliminating the need for cable 115. As illustrated in FIG. 21, circuit 111 includes both a crossover circuit 2101 and a wireless receiver 2103. Wireless receiver 2103 receives the electrical signals from external audio source 113 that are representative of the sound to be generated by the IEM's drivers. It will be appreciated receiver 2103 may use any of a variety of wireless communication protocols (e.g., 802.11a/b/g/n, Bluetooth, 802.16a/d/e, etc.) and that the invention is not limited to a specific protocol. Additionally, while wireless receiver 2103 is only shown implemented within a generic IEM utilizing dual concentric bores and dual armature drivers, it may be used with any of the other embodiments of the invention.

Figure 22:
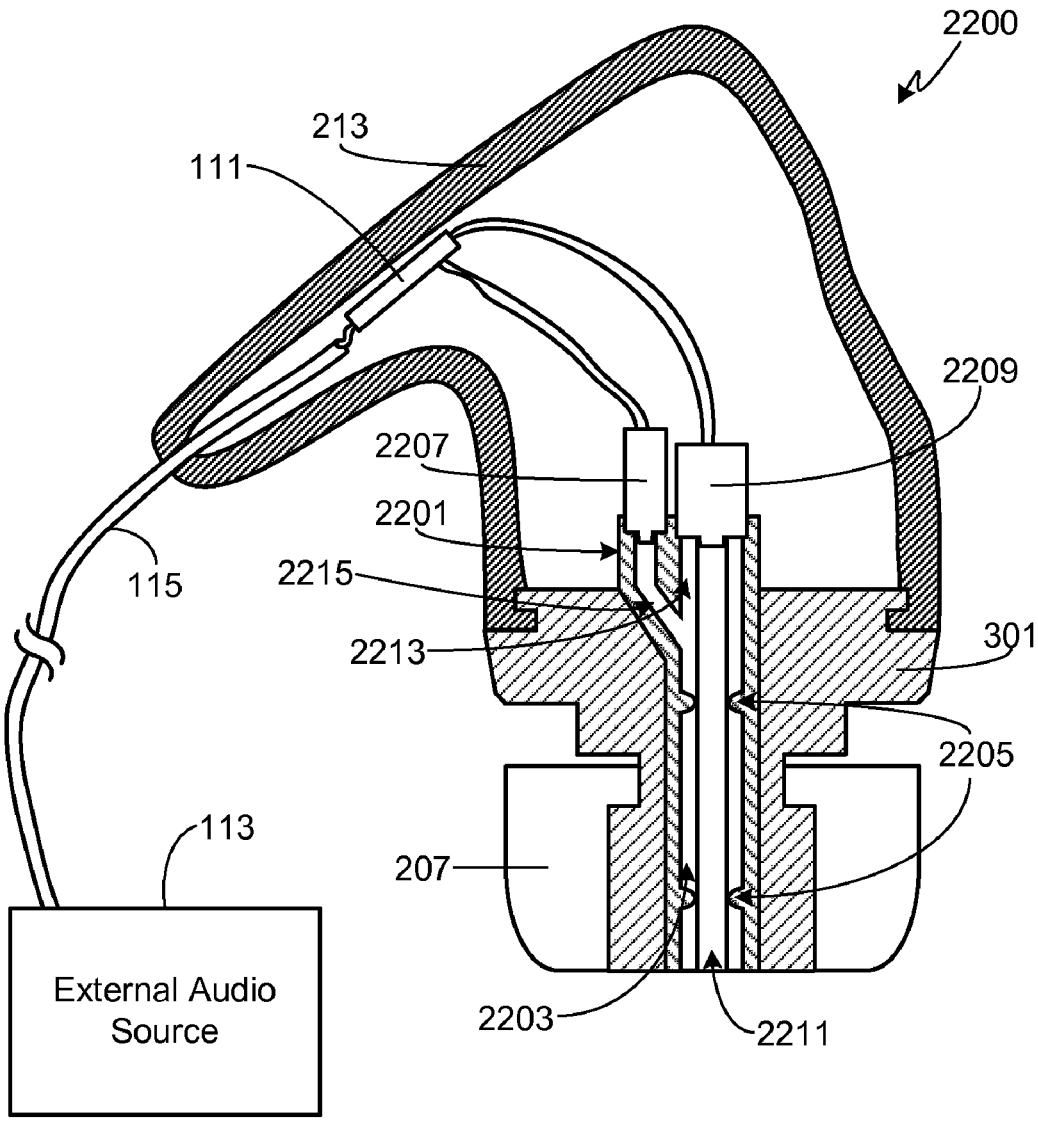
FIG. 22 illustrates a merged concentric sound bore configuration.

As previously noted, the exact configuration of the sound delivery tubes of the present invention depend on a number of factors, such as IEM type (generic versus custom fit); the number, size and type of drivers; the number of sound delivery tubes as well as their arrangement within the IEM; the use/location of dampers; etc. Accordingly, the illustrations provided herein should only be viewed as examples of the various embodiments of the invention, rather than limitations of the invention. For example, the drivers may be coupled to the sound delivery tubes using any of a variety of techniques, the concentric sound delivery tubes may be spaced apart using any of a variety of different member types and shapes, and the drivers may be located within the IEM enclosure in any of a variety of different positions. FIG. 22 illustrates some of these variations based on the embodiment shown in FIG. 4, IEM 2200 utilizing a single component that defines a driver boot portion 2201, an outer concentric sound delivery tube 2203, and integrated support members 2205. Boot portion 2201 includes regions for mounting both a first driver 2207 and a second driver 2209. Acoustically coupled to driver 2209 is inner concentric sound delivery tube 2211, tube 2211 being spaced apart from tube 2203 by members 2205. As shown, there is a region 2213 between driver 2209 and the point at which tube 2215 merges with tube 2203, this region used to tune the performance of the drivers. Note that as in the prior embodiments, the support members (i.e., members 2205) are designed to support inner bore 2211 without significantly occluding outer tube 2203, or significantly impacting the quality of the sound passing through outer tube 2203.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

The invention claimed is:

1. An in-ear monitor for producing sound and coupleable to an external audio source, said in-ear monitor comprising:

an in-ear monitor enclosure;

at least two drivers disposed within said in-ear monitor enclosure;

a circuit contained within said in-ear monitor enclosure and electrically coupled to said at least two drivers, wherein said circuit is configured to receive an electrical signal representative of said sound from said external audio source and provide separate input signals to said at least two drivers based on said electrical signal, wherein said external audio source generates said electrical signal, and wherein said external audio source is separate and independent from said in-ear monitor; and at least two concentric sound delivery tubes disposed within said in-ear monitor enclosure, said at least two concentric sound delivery tubes acoustically coupling said at least two drivers to an in-ear monitor enclosure acoustic output surface.

2. The in-ear monitor of claim 1, wherein said at least two drivers are comprised of a first driver and a second driver, wherein said at least two concentric sound delivery tubes are comprised of an inner sound delivery tube and an outer sound delivery tube, and wherein a first driver acoustic output is acoustically coupled to said inner sound delivery tube and a second driver acoustic output is acoustically coupled to said outer sound delivery tube.

3. The in-ear monitor of claim 2, wherein said first driver outputs a first range of frequencies and said second driver outputs a second range of frequencies.

4. The in-ear monitor of claim 2, further comprising:

a third driver disposed within said in-ear monitor enclosure; and an independent sound delivery tube disposed within said in-ear monitor enclosure and discrete from said at least two concentric sound delivery tubes and acoustically coupled to a third driver acoustic output, wherein said independent sound delivery tube acoustically couples said third driver acoustic output to said in ear monitor enclosure acoustic output surface.

5. The in-ear monitor of claim 2, further comprising a third driver acoustically coupled to said inner sound delivery tube, wherein said inner sound delivery tube acoustically couples a third driver acoustic output to said in-ear monitor enclosure acoustic output surface.

6. The in-ear monitor of claim 2, further comprising a third driver acoustically coupled to said outer sound delivery tube, wherein said outer sound delivery tube acoustically couples a third driver acoustic output to said in-ear monitor enclosure acoustic output surface.

7. The in-ear monitor of claim 2, said circuit further comprising a wireless receiver disposed within said in-ear monitor enclosure and configured to wirelessly receive said electrical signal from said external audio source.

8. The in-ear monitor of claim 2, further comprising a source input cable attached to said in-ear monitor enclosure and electrically coupled to said circuit, wherein said source input cable is coupleable to said external audio source and receives said electrical signal from said external audio source.

9. The in-ear monitor of claim 8, further comprising a cable socket, wherein said source input cable is attached to said in-ear monitor enclosure via said cable socket.

10. The in-ear monitor of claim 2, wherein said in-ear monitor is a custom fit in-ear monitor.

11. The in-ear monitor of claim 2, wherein said in-ear monitor enclosure is configured to accept a removable eartip.

12. The in-ear monitor of claim 2, said circuit further comprising a passive crossover circuit.

13. The in-ear monitor of claim 2, said circuit further comprising an active crossover circuit.

14. The in-ear monitor of claim 2, further comprising an acoustic filter interposed between said first driver acoustic output and said inner sound delivery tube.

15. The in-ear monitor of claim 2, further comprising an acoustic filter within said inner sound delivery tube.

16. The in-ear monitor of claim 2, further comprising an acoustic filter interposed between said second driver acoustic output and said outer sound delivery tube.

17. The in-ear monitor of claim 2, further comprising an acoustic filter within said outer sound delivery tube.

18. The in-ear monitor of claim 2, further comprising a plurality of support members, wherein said plurality of support members maintain spacing between said inner sound delivery tube and said outer sound delivery tube.

19. The in-ear monitor of claim 1, wherein said at least two drivers are comprised of a first driver, a second driver and a third driver, wherein said at least two concentric sound delivery tubes are comprised of an inner sound delivery tube, an outer sound delivery tube, and a middle sound delivery tube interposed between said inner and outer sound delivery tubes, and wherein a first driver acoustic output is acoustically coupled to said inner sound delivery tube, a second driver acoustic output is acoustically coupled to said middle sound delivery tube, and a third driver acoustic output is acoustically coupled to said outer sound delivery tube.

20. The in-ear monitor of claim 19, wherein said first driver outputs a first range of frequencies, said second driver outputs a second range of frequencies, and said third driver outputs a third range of frequencies.

21. The in-ear monitor of claim 19, further comprising a fourth driver acoustically coupled to said inner sound delivery tube, wherein said inner sound delivery tube acoustically couples a fourth driver acoustic output to said in-ear monitor enclosure acoustic output surface.

22. The in-ear monitor of claim 19, further comprising a fourth driver acoustically coupled to said middle sound delivery tube, wherein said middle sound delivery tube acoustically couples a fourth driver acoustic output to said in-ear monitor enclosure acoustic output surface.

23. The in-ear monitor of claim 19, further comprising a fourth driver acoustically coupled to said outer sound delivery tube, wherein said outer sound delivery tube acoustically couples a fourth driver acoustic output to said in-ear monitor enclosure acoustic output surface.

24. The in-ear monitor of claim 19, said circuit further comprising a wireless receiver disposed within said in-ear monitor enclosure and configured to wirelessly receive said electrical signal from said external audio source.

25. The in-ear monitor of claim 19, further comprising a source input cable attached to said in-ear monitor enclosure and electrically coupled to said circuit, wherein said source input cable is coupleable to said external audio source and receives said electrical signal from said external audio source.

26. The in-ear monitor of claim 25, further comprising a cable socket, wherein said source input cable is attached to said in-ear monitor enclosure via said cable socket.

27. The in-ear monitor of claim 19, wherein said in-ear monitor is a custom fit in-ear monitor.

28. The in-ear monitor of claim 19, wherein said in-ear monitor enclosure is configured to accept a removable eartip.

29. The in-ear monitor of claim 19, said circuit further comprising a passive crossover circuit.

30. The in-ear monitor of claim 19, said circuit further comprising an active crossover circuit.

31. The in-ear monitor of claim 19, further comprising an acoustic filter interposed between said first driver acoustic output and said inner sound delivery tube.

32. The in-ear monitor of claim 19, further comprising an acoustic filter within said inner sound delivery tube.

33. The in-ear monitor of claim 19, further comprising an acoustic filter interposed between said second driver acoustic output and said middle sound delivery tube.

34. The in-ear monitor of claim 19, further comprising an acoustic filter within said middle sound delivery tube.

35. The in-ear monitor of claim 19, further comprising an acoustic filter interposed between said third driver acoustic output and said outer sound delivery tube.

36. The in-ear monitor of claim 19, further comprising an acoustic filter within said outer sound delivery tube.

37. The in-ear monitor of claim 19, further comprising a first plurality of support members and a second plurality of support members, wherein said first plurality of support members maintain spacing between said inner sound delivery tube and said middle sound delivery tube, and wherein said second plurality of support members maintain spacing between said middle sound delivery tube and said outer sound delivery tube.

* * * * *